United States Patent [19]

Fujiki

[11] Patent Number: 4,974,133

[45] Date of Patent: Nov. 27, 1990

[54] LIGHTING APPARATUS

[75] Inventor: Masaru Fujiki, Tokyo, Japan

[73] Assignee: Iskra Industry Co., Ltd., Tokyo, Japan

[21] Appl. No.: 452,600

[22] Filed: Dec. 18, 1989

[30] Foreign Application Priority Data

Aug. 25, 1989 [JP] Japan ..... 1-219332
Aug. 25, 1989 [JP] Japan ..... 1-219333

[51] Int. Cl.[5] ..... F21V 13/12

[52] U.S. Cl. ..... 362/283; 362/284; 362/293; 362/811

[58] Field of Search ..... 362/811, 806, 122, 293, 362/32, 101, 281, 282, 283, 284

[56] References Cited

U.S. PATENT DOCUMENTS

| | | | |
|---|---|---|---|
| 1,043,981 | 11/1912 | Strong | 362/811 |
| 2,055,777 | 9/1936 | Shigley | 362/811 |
| 2,554,063 | 5/1951 | Serrine | 362/806 |
| 2,721,256 | 10/1955 | Duhon | 362/811 |
| 3,080,474 | 3/1963 | Allen | 362/811 |
| 3,536,908 | 10/1970 | Oster | 362/123 |
| 3,755,664 | 8/1973 | Reiback | 362/811 |
| 3,762,082 | 10/1973 | Mincy | 362/811 |
| 3,803,398 | 4/1974 | Walker | 362/32 |
| 4,206,495 | 6/1980 | McCaslin | 362/811 |
| 4,527,186 | 7/1985 | Alker | 362/811 |

FOREIGN PATENT DOCUMENTS 2189638 10/1987 United Kingdom ..... 362/806

*Primary Examiner*—Ira S. Lazarus
*Assistant Examiner*—Richard R. Cole
*Attorney, Agent, or Firm*—Frishauf, Holtz, Goodman & Woodward

[57] ABSTRACT

A lighting apparatus is provided which comprises a color disc capable of transmitting light therethrough and arranged within a housing having an opening. The color disc has a planar surface parallel to the opening, and a large number of subdivided sections defined on the planar surface. The subdivided sections are individually colored in one of a plurality of colors such that, when viewed as a whole, the planar surface has a plurality of identical coloration patterns each consisting of the subdivided sections of the same color and that any adjacent ones of the coloration patterns are different in color from each other. A shutter disc is arranged between the color disc and the opening and has a large number of windows for permitting only those subdivided sections forming one of the coloration patterns to be exposed to the outside of the housing when the shutter disc is at a predetermined rotational angle position. The lighting apparatus further comprises a motor for rotating the shutter disc, and an illuminating bulb arranged at the opening for radiating the light from the opening to the outside of the housing.

13 Claims, 6 Drawing Sheets

LIGHTING APPARATUS

BACKGROUND OF THE INVENTION

This invention relates to a lighting apparatus, and more particularly, to a lighting apparatus suited to calm the mental or psychological state of users.

In recent years, people have come to pay more attention to their health, and accordingly, various health foods are put on sale in quantities, while many enjoy sports such as jogging, walking, etc.

The health foods and sports, however, are primarily intended to improve the physical condition of the body, and do not directly serve to calm the mental or psychological state. Namely, they do not have the effect of instantly easing mental or psychological stress or calming the state of mind.

It is said that listening to beautiful music or enjoying a fine view of nature is good for calming one's mental state. Beautiful music serves to calm the mind through the ear, and scenic beauty serves to calm one through the eye.

While beautiful music is relatively easily available at home, by using a stereophonic sound reproduction apparatus, it is not easy to enjoy a fine view of nature, because usually one must travel to a distant beauty spot to enjoy such scenic beauty, thus requiring much time and traveling expenses.

OBJECTS AND SUMMARY OF THE INVENTION

This invention was contrived in view of the above circumstances, and an object thereof is to provide a lighting apparatus which can be easily used at home or the like and can produce colors as well as changes of colors suited for calming the mental state of users.

The above object is achieved by a lighting apparatus according to this invention which comprises: a housing having an opening in an outer wall thereof; a light source arranged within the housing, for emitting light toward the opening; a colored member arranged between the light source and the opening and capable of transmitting light therethrough, the colored member having a planar surface parallel to the opening, and a large number of subdivided sections defined on the planar surface, the subdivided sections being individually colored in one of a plurality of colors such that, when viewed as a whole, the planar surface has a plurality of identical coloration patterns each consisting of the subdivided sections of the same color and that any adjacent ones of the coloration patterns are different in color from each other; a light-intercepting member arranged between the colored member and the opening, and having a shutter surface parallel to the planar surface of the colored member and a large number of windows formed in the shutter surface for permitting only those subdivided sections forming one of the coloration patterns to be exposed to outside of the housing when the light-intercepting member is located in a predetermined position with respect to the colored member; shifting means for effecting a relative movement between the planar surface of the colored member and the shutter surface of the light-intercepting member such that the subdivided sections forming at least two neighboring coloration patterns are located at the individual windows of the light-intercepting member; and radiating means provided at the housing, for radiating the light from the opening to outside of the housing.

According to the above lighting apparatus of the invention, the planar surface of the colored member and the shutter surface of the light-intercepting member are moved relative to each other such that the subdivided sections forming at least two neighboring coloration patterns are located at the individual windows of the light-intercepting member. Accordingly, while in this state, as light from the light source passes through the colored member and the windows of the light-intercepting member, it is colored in a neutral color due to the mixture of the colors of the coloration patterns. The neutral-color light is radiated to the outside through the opening of the housing and the radiating means.

As the relative movement between the planar surface of the colored member and the shutter surface of the light-intercepting member is continuously carried out, the areas of the subdivided sections of different colors exposed through the individual windows vary in size, whereby the neutral color radiated from the lighting apparatus also incessantly varies.

Further, the lighting apparatus according to this invention is comparatively simple in arrangement and its size can be freely selected, thus enabling the use of the lighting apparatus at home.

The above and other objects, features, and advantages of this invention will become more apparent from the ensuing detailed description taken in conjunction with the accompanying drawings.

DETAILED DESCRIPTION

Figure 1:
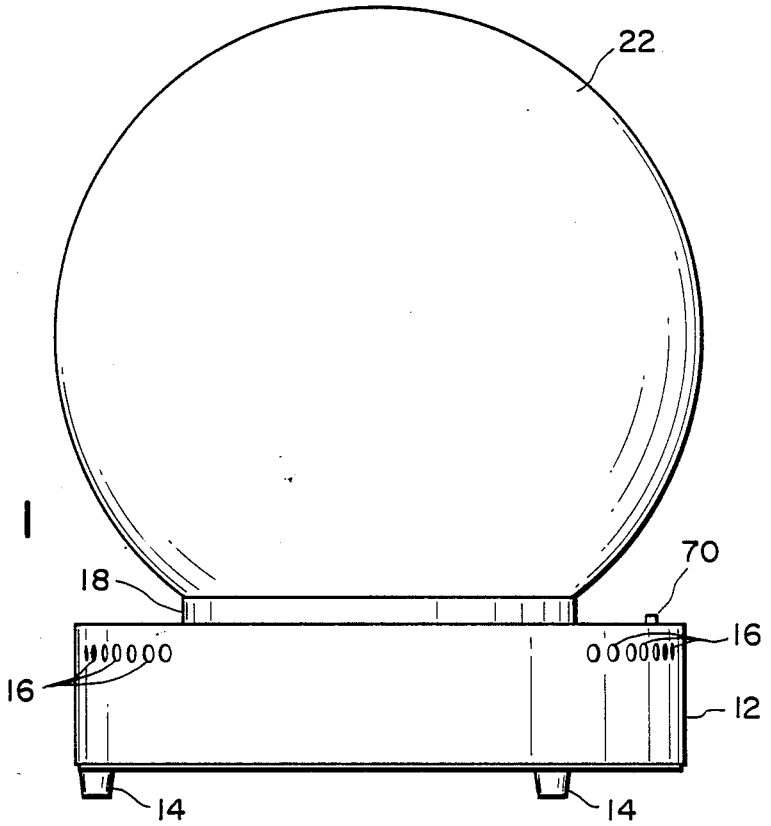
FIG. 1 is a front view of a lighting apparatus according to one embodiment of this invention.
Figure 2:
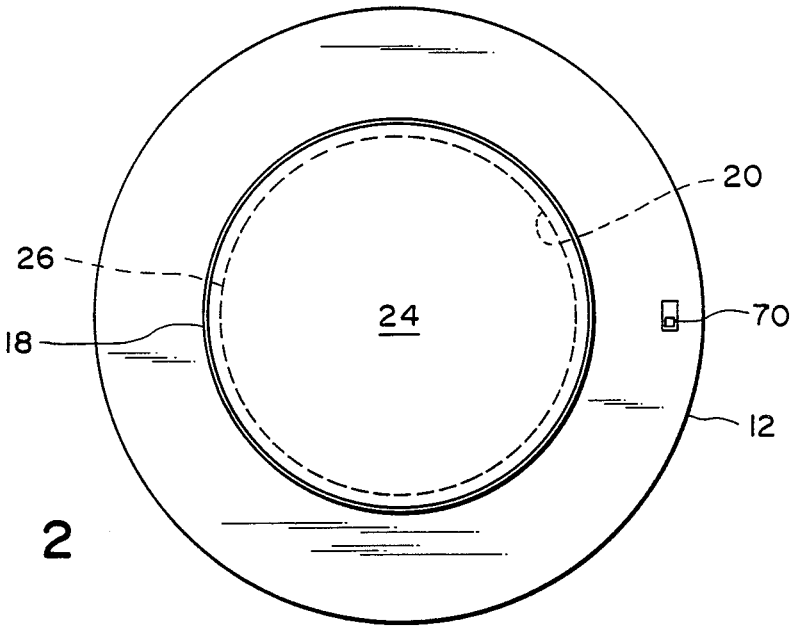
FIG. 2 is a plan view of the lighting apparatus of FIG. 1 with an illuminating bulb thereof removed.

A lighting apparatus shown in FIG. 1 is of a type placed on a stand such as a table, desk, or the like, and has a cylindrical housing 12 of a relatively flat shape and three legs 14 attached to the bottom surface of the housing 12. The legs 14 are made of an elastic material such as rubber and arranged equidistantly in the circumferential direction of the housing 12. Accordingly, the housing 12 is placed on, e.g., a table with the legs 14 therebetween. A plurality of vent holes 16 are formed at each of three circumferentially equidistant portions of the peripheral wall of the housing 12, and a ring-like neck portion 18 projects from the upper surface of the housing 12 concentrically therewith. The neck portion 18 is in communication with the interior of the housing 12 through a circular opening 20 bored through the upper surface of the housing 12 (see FIGS. 2 to 4). Detachably mounted to the neck portion 18 is a spherical illuminating bulb 22 which is made of a colorless, translucent material such as a plastic material, glass, or the like. FIG. 1 shows only two of the legs 14 and of the portions at which the vent holes 16 are formed.

The above-mentioned opening 20 is closed by a diffusing disc 24, which is made of, e.g., a fireproof synthetic resin and which serves to transmit incident light therethrough while diffusing the same. As clearly shown in FIGS. 3 and 4, the diffusing disc 24 is supported by an annular flange 26 projecting from the inner proximal edge of the neck portion 18 toward the opening 20.

Figure 5:
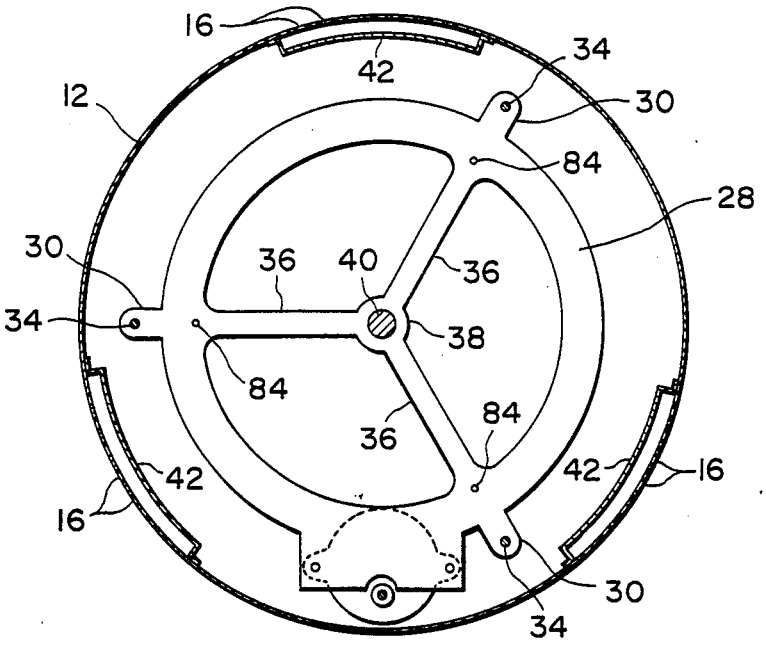
FIG. 5 is a plan view of a support frame of the lighting apparatus shown in FIG. 1.

A support frame 28 is arranged within the housing 12 and positioned horizontally under the opening 20. The support frame 28 comprises a thin ring plate having an inner diameter larger than that of the opening 20. As shown in FIG. 5, three mounting lugs 30 protrude from the outer peripheral edge of this ring plate at circumferentially equal distances, and a hole is bored through each of the mounting lugs 30. Cylindrical protuberances 32 project integrally from the inner surface of the upper wall of the housing 12 corresponding in position to the mounting lugs 30 of the support frame 28, and a threaded hole is cut in each of the lower end portions of the protuberances 32. Thus the support frame 28 is secured to the three protuberances 32 and therefore to the housing 12 by screws 34, with the mounting lugs 34 thereof set at the associated protuberances 32.

The support frame 28 has three arms 36 extending from the inner peripheral edge to the axis thereof and located equidistantly in the circumferential direction. The inner ends of these arms 36 are connected together at a bearing portion 38. The bearing portion 38 is in the form of a cylinder extending toward the interior of the housing 12, and an axis thereof is in alignment with the axis of the support frame 28. In the bearing portion 38, a shaft-fitting hole 40 is formed which is open at one end close to the above-mentioned neck portion 18 and closed at the other end. In FIG. 5, reference numeral 42 denotes cover plates arranged at the peripheral wall portions of the housing 12 through which the aforesaid vent holes 16 are formed, for covering the same portions from inside. The cover plates 42 are open at vertically opposite ends thereof.

An illuminant 44 is arranged under the above-mentioned support frame 28 and, in this embodiment, comprises four fluorescent lamps 46 juxtaposed to one another and in parallel to the support frame 28. The fluorescent lamps 46 are attached at one end to a holder 48 which is secured to the bottom wall of the housing 12 by a bracket 50. Thus, as seen from FIGS. 3 and 4, the four fluorescent lamps 46 are located at a predetermined distance from the bottom wall of the housing 12. Reference numeral 52 denotes screws for fixing the bracket 50.

A reflecting plate 54 is arranged between the fluorescent lamps 46 and the bottom wall of the housing 12. The reflecting plate 54 has such a shape as to cover the four fluorescent lamps 46 from below and is secured to the bottom wall of the housing 12 by spacers 56 and screws 58.

A transformer 60 and a glow lamp 62 for lighting the fluorescent lamps 46 are arranged beside the fluorescent lamps 46 and the reflecting plate 54. The transformer 60 is secured to the bottom wall of the housing 12 by spacers 64 and screws 66, and the glow lamp 62 is also secured to the bottom wall of the housing 12 by a bracket 68. A switch 70 for operating the lighting apparatus of this invention is provided on the upper surface of the housing 12. For the sake of simplicity, the wiring between the switch 70, transformer 60 and glow lamp 62, and a line connected to a power supply are omitted from the drawings.

Figure 3:
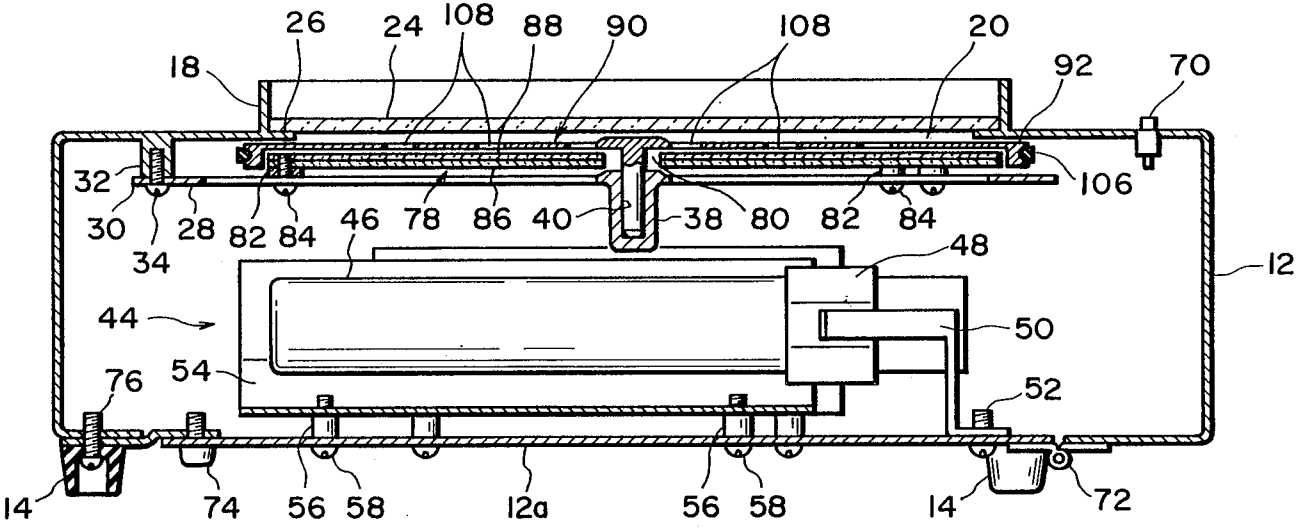
FIG. 3 is a longitudinal sectional view of the lighting apparatus of FIG. 2.
Figure 4:
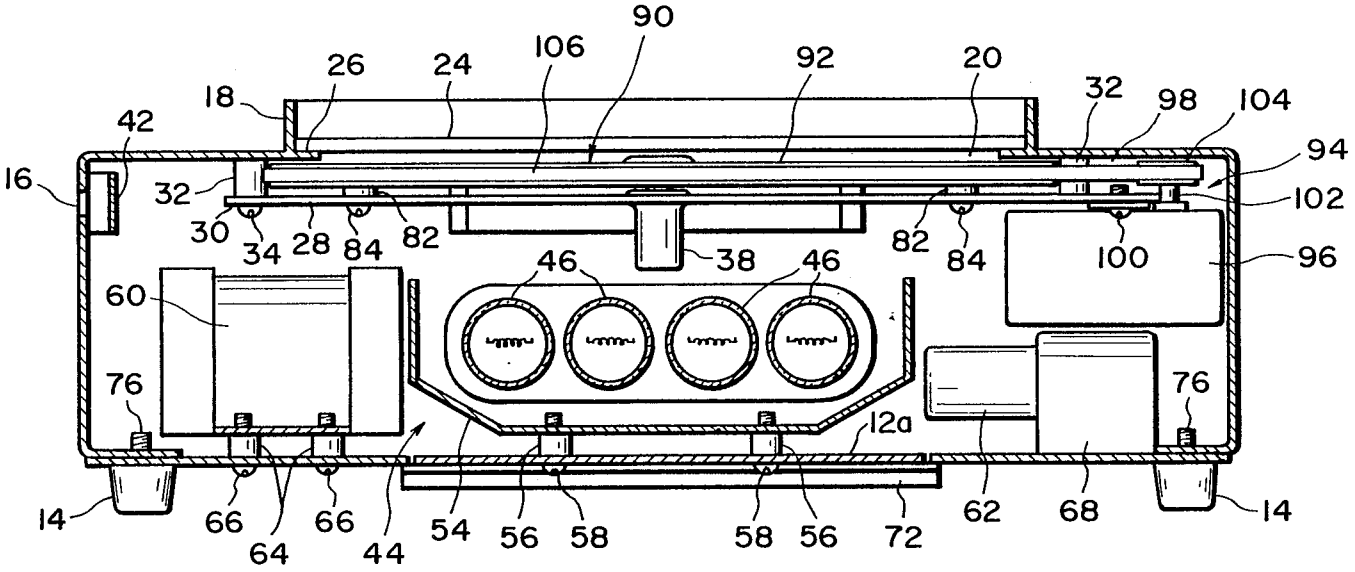
FIG. 4 is a longitudinal sectional view of the lighting apparatus of FIG. 2 taken in a direction different from that of FIG. 3.
Figure 6:
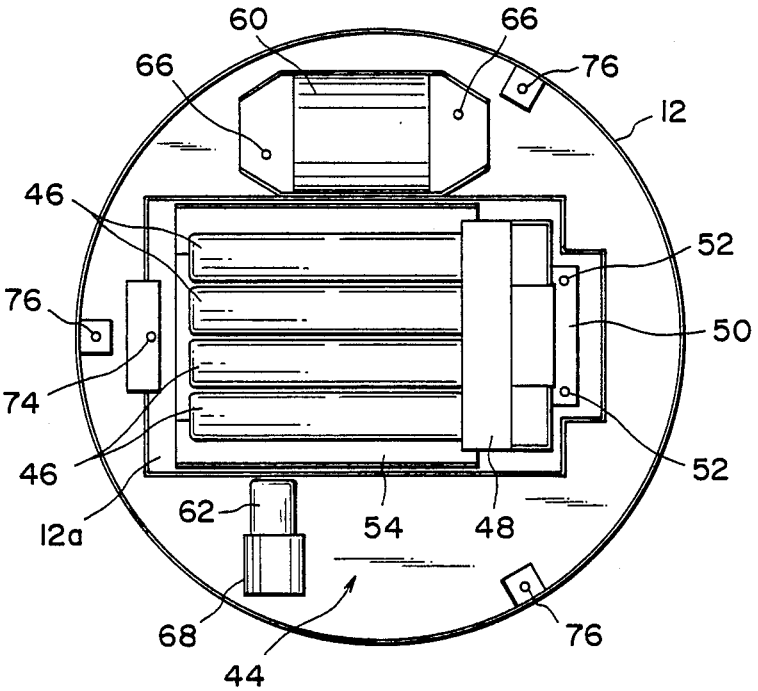
FIG. 6 is a plan view of an illuminant of the lighting apparatus of FIG. 1.

A portion 12*a* of the bottom wall of the housing 12 to which the fluorescent lamps 46 and the reflecting plate 54 are attached is separated from the other bottom wall portion. This portion 12*a* is, as shown in FIG. 6, generally rectangular in shape, and has a side edge thereof attached to the other bottom wall portion by a hinge 72, as clearly shown in FIGS. 3 and 4. The opposite side edge of the portion 12*a* is fixed to the surrounding bottom wall portion by a screw 74. Accordingly, the portion 12*a* is allowed to swing on the hinge 72 to open and close when the screw 74 is removed, thus facilitating the replacement of fluorescent lamps 46. In FIGS. 3, 4, and 6, reference numeral 76 denotes screws for the aforesaid legs 14.

Between the support frame 28 and the aforesaid diffusing disc 24 is arranged a color disc 78 which has an outer diameter slightly larger than the inner diameter of the support frame 28 as well as than the diameter of the opening 20 and has a hole 80 formed at the center thereof coaxially with the shaft-fitting hole 40 of the bearing portion 38 of the support frame 28. The diameter of the hole 80 is slightly larger than that of the shaft-fitting hole 40. The color disc 78 is secured at a peripheral edge portion thereof to the support frame 28 by three spacers 82 and screws 84 associated therewith which are located equidistantly in the circumferential direction.

The color disc 78 of this embodiment comprises a circular color film 86 capable of transmitting light therethrough, and a circular transparent film 88 bonded to the color film 86, if necessary. The films 86 and 88 each have a hole formed therethrough in alignment with the aforesaid hole 80.

Figure 7:
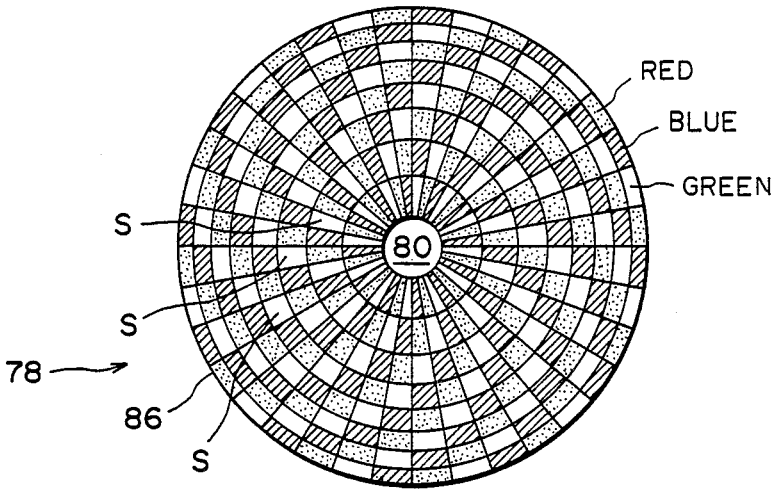
FIG. 7 is a plan view of a color disc.

As shown in FIG. 7, the color film 86 of the color disc 78 is colored, for example, in the three primary colors of red, blue, and green, which colors may be sequentially printed on the surface of the film 86. In FIG. 7, the dotted portions indicate regions of the film 86 colored in red, the hatched portions indicate regions colored in blue, and the blank portions except for the aforesaid hole 80 indicate regions colored in green.

In this embodiment, the three primary colors of red, blue and green are distributed to different ones of a large number of subdivided sections, as shown in FIG. 7. Specifically, the entire area of the color film 86 is divided into circumferentially equal thirty-six sectors S, and these sectors S are further divided by a large number of, in this embodiment, seven, circles which are concentric with the axis of the color film 86. Thus the color film 86 has a large number of subdivided sections as mentioned above, which are divided by the radial lines defining the sectors S and by the concentric circles.

Now, the coloration of the subdivided sections will be described, noting first the innermost ring of subdivided sections located between the innermost concentric circle and the hole 80 as viewed in the radius direction of the color film 86. In this innermost ring, taking a red section as the start, the sections subsequent to this red section in the clockwise direction in FIG. 7 are colored in the order of blue, green, red, blue, green, and so on. Likewise, in the neighboring ring of subdivided sections having the second smallest diameter, the sections are colored in the order of blue, green, red, blue, green, and so on in the clockwise direction. However, comparing the subdivided sections of the same colors in these two rings, the ring with the second smallest diameter is shifted by one subdivided section from the ring with the smallest diameter in the circumferential direction, in this embodiment, the clockwise direction, of the color disc 78, as viewed in the order of the coloration.

Similarly, in each of the rings of subdivided sections having a larger diameter than its inward neighboring one, the sections are colored in the above-mentioned order of colors and the color arrangement thereof is shifted by one phase or one subdivided section in the clockwise direction with respect to the neighboring ring located inward in the radius direction of the color disc 78. Accordingly, as seen from FIG. 7, the subdivided sections of the same color form spiral curves.

The color film 86, though colored in the aforesaid manner, can sufficiently transmit light therethrough, and in this embodiment, the rings of subdivided sections have widths decreasing stepwise or continuously with an increase in the diameter, as clearly shown in FIG. 7.

Between the aforesaid color disc 78 and the diffusing disc 24 is arranged a shutter disc 90 which is closer to the color disc 78 than to the diffusing disc 24 and has a light-intercepting capability. The shutter disc 90 has a diameter larger than that of the color disc 78 and has a pivot shaft 92 at the center thereof which projects toward the color disc 78. The pivot shaft 92 is passed through the hole 80 of the color disc 78 and is rotatably fitted into the shaft-fitting hole 40 of the bearing portion 38 of the support frame 28.

A flange-like pulley wheel 92 is formed integrally with the outer peripheral edge of the shutter disc 90 such that it projects downward as viewed in FIG. 3 and surrounds the color disc 78 from outside. A driving mechanism 94 for rotating the shutter disc 90 is arranged near the outer peripheral edge of the color disc 78, as shown in FIG. 4. The driving mechanism 94 includes a motor 96 mounted to the upper wall of the housing 12 by a bracket 98 and screws 100. The motor 96 has an output shaft 102 which projects upward as illustrated and to which a driving pulley 104 is attached. The driving pulley 104 is arranged on a level with the shutter disc 90, namely, the pulley wheel 92. A driving belt 106 is wound around the driving pulley 104 and the pulley wheel 92, whereby as the motor 96 is driven, the shutter disc 90 is rotated through the driving belt 106. The shutter disc 90 is rotated by the motor 96 either continuously or intermittently at a constant speed. The motor 96 is started by an operation of the aforementioned switch 70.

Figure 8:
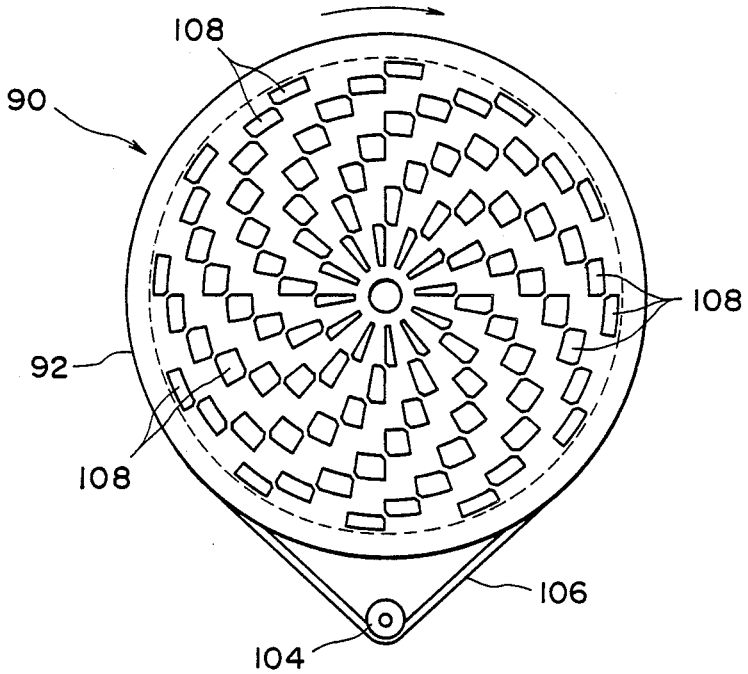
FIG. 8 is a plan view of a shutter disc.

As clearly shown in FIG. 8, the shutter disc 90 has a large number of windows 108 which are arranged such that, when the shutter disc 90 is positioned at a predetermined angle of rotation, all of the subdivided sections colored in the same color, for example, only those colored in red, are exposed through the windows 108. The windows 108 are equal in size to the associated subdivided sections.

The function of the lighting apparatus constructed as above will now be described.

Upon turning on of the switch 70, the fluorescent lamps 46 are lighted and simultaneously the shutter disc 90 is rotated clockwise, as indicated by the arrow in FIG. 8, at a predetermined speed such that the shutter disc 90 makes one complete rotation in, for example, two minutes. Thus it takes about three seconds for one window 108 of the shutter disc 90 to pass over one subdivided section.

Light directly radiated from the fluorescent lamps 46, along with light reflected by the reflecting plate 54, passes through the openings defined by the arms 36 of the support frame 28, the color disc 78, the windows 108 of the shutter disc 90, and the diffusing disc 24 into the illuminating bulb 22, and then is irradiated to the outside through the outer wall of the illuminating bulb 22.

The subdivided sections of the color disc 78, namely, the color film 86, are individually colored in one of the three primary colors, as mentioned above, and therefore, as light from the fluorescent lamps passes through the subdivided sections, it is colored in the corresponding colors. In practice, however, only those colored light beams that pass through the windows 108 of the shutter disc 90 are allowed to reach the illuminating bulb 22. Accordingly, when the shutter disc 90 is located at such a rotational position that those subdivided sections of the color disc 78 which are colored, for example, in red, are exposed through the windows 108, only the light beams colored in red are allowed to reach the illuminating bulb 22, whereby only the red light beams are irradiated to the outside from the illuminating bulb 22.

Figure 9:
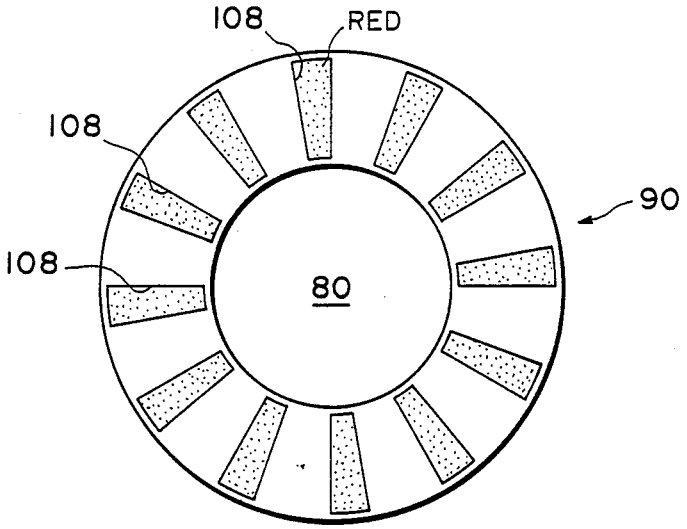
FIGS. 9 and 10 are diagrams respectively illustrating the function of the lighting apparatus.
Figure 10:
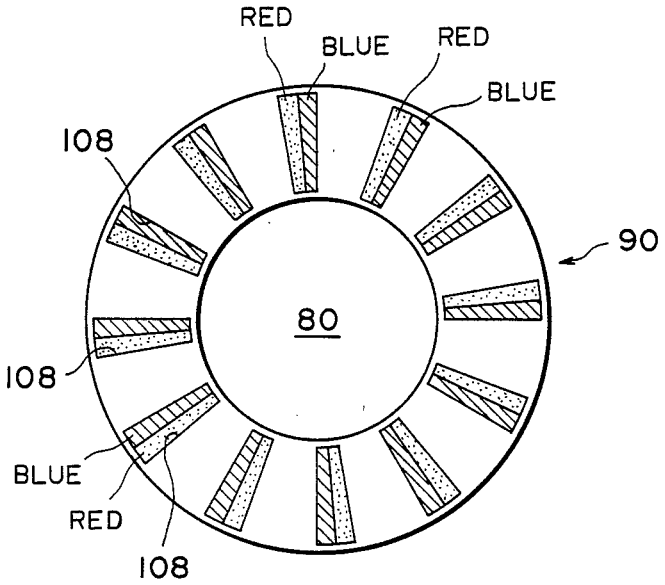

Since the shutter disc 90 is continuously rotated at a fixed speed, the windows 108 thereof are frequently located such that two subdivided sections neighboring in the circumferential direction of the color disc 78 are exposed through one window 108, as shown in FIG. 10. In this case, the colored light beams passing the respective windows are mixed to produce a neutral tint or color, and accordingly, the light of the neutral tint is irradiated to the outside from the illuminating bulb 22. FIGS. 9 and 10 show only the smallest-diameter ring of subdivided sections of the color disc 78 and the corresponding portion of the shutter disc 90.

As is clear from the above description, as the shutter disc 90 is continuously rotated from the position shown in FIG. 9, the color of the light irradiated to the outside from the illuminating bulb 22 changes in the sequence of red, a color between red and blue, blue, a color between blue and green, green, a color between green and red, and red. The various neutral colors between primary colors also gradually change from one primary color to another.

As described above, upon operating the lighting apparatus of the invention, the user can enjoy light of neutral colors irradiated from the illuminating bulb 22 and incessantly varying in tints. As the variation of neutral colors affects the chromatopsia of the user through the optic nerves, the user may fall in meditation so that mental stress is removed and the mental state is calmed down.

It is generally known that seeing loud colors for a long time causes a strain on one's nerves, giving an uneasy feeling. According to the lighting apparatus of the invention, however, the primary colors of red, blue and green are irradiated from the illuminating bulb 22 for only a short period of time; namely, in the course of the rotation of the shutter disc 90, the windows 108 of the shutter disc 90 only momentarily coincide exactly with the subdivided sections of the color disc 78 colored in the same color. Accordingly, there is substantially no time when a primary color alone is irradiated from the illuminating bulb 22, whereby advantages are provided in that the mental stress of the user is removed, thus calming the mental state, and the user's health can be promoted from the standpoint of psychology.

Each group of the subdivided sections of the color disc 78 colored in the same color forms spiral curves distributed over the entire surface of the color disc 78, and accordingly, the colored light passed through the group of the subdivided sections is radiated from the entire surface of the color disc 78. Further, the colored light is diffused while transmitting through the diffusing disc 24 and then guided into the illuminating bulb 22, whereby the colored light actually radiated to the outside from the illuminating bulb 22 can be made uniform.

Moreover, the lighting apparatus of this invention is simple in arrangement and its size can be relatively freely selected, thus enabling the use of the lighting apparatus at home.

This invention is not limited to the above-described embodiment, but various modifications are possible. For example, in the above embodiment, the shutter disc 90 is rotated, but alternatively, the disc may be fixed and the color disc 78 may be rotated instead.

Further, the shutter disc 90 need not be rotated continuously; it may be rotated intermittently, or if the user desires, the lighting apparatus of the invention may be used with the shutter disc 90 stopped. To permit the lighting apparatus to be used with the shutter disc 90 stopped, it is necessary that the switch for the fluorescent lamps 46 and the switch for the motor 96 should be provided separately.

Furthermore, the subdivided sections of the color disc 78 need not be indivdually colored in one of the three primary colors. Alternatively, they may be individually colored in one of three different neutral colors beforehand.

Further, instead of the color disc 78, a transparent endless belt colored in different colors may be used in such a way that it is caused to run at a predetermined speed, in combination with a shutter plate securely arranged above the belt.

What is claimed is:

1. A lighting apparatus comprising:

a housing having an opening formed in a portion of an outer wall thereof;

a light source arranged within said housing, for emitting light toward said opening;

a substantially flat color disc arranged between said light source and said opening and capable of transmitting light therethrough, said color disc having an outer surface opposed to said opening, an inner surface opposed to said light source, and a large number of subdivided sections defined over an entire area thereof, said subdivided sections being arranged contiguously such that boundaries of one subdivided section extending in a circumferential direction and a radius direction of the color disc coincide with boundaries of adjacent subdivided sections, and individually colored in one of predetermined colors such that the color of one subdivided section differs from that of the subdivided sections contiguous thereto in the circumferential direction and radius direction of the color disc, to thereby define a plurality of coloration patterns comprised of the subdivided sections colored in the same color, each of the coloration patterns having a configuration such that when the color disc is rotated by a predetermined angle about an axis thereof, one coloration pattern perfectly coincides with another;

a light-intercepting disc arranged in parallel to the color disc close to the outer surface of same, said light-intercepting disc covering the entire outer surface of the color disc, and having a large number of windows of the same size and shape as cooperating subdivided sections of said color disc such that said windows, when the light-intercepting disc is located at a predetermined rotational angle relative to the color disc, respectively coincide with the subdivided sections forming one coloration pattern and thus permit same to be exposed therethrough to the opening of the housing;

driving means for rotating one of the color disc and the light-intercepting disc at a predetermined speed, to successively expose all of the subdivided sections forming the individual coloration patterns through the windows of the light-intercepting disc; and a translucent illuminating bulb arranged at the opening of said housing, for radiating the light from the opening to the outside of the housing;

said driving means including support means for rotatably supporting the light-intercepting disc, said support means including an annular frame mounted between the color disc and the light source, a pivot bearing provided substantially at a center of the annular frame and supported by a plurality of arms, and a pivot shaft rotatably supported by the pivot bearing, said pivot shaft extending through the color disc and being connected to a central portion of the light-intercepting disc for thereby rotatably supporting the light-intercepting disc.

2. A lighting apparatus according to claim 1, wherein said subdivided sections of the color disc are defined by dividing a plurality of sectors obtained by dividing the color disc equidistantly in the circumferential direction thereof, by a plurality of concentric circles in the radius direction of the color disc.

3. A lighting apparatus according to claim 2, wherein said subdivided sections form a plurality of groups each defined by two concentric circles adjacent to each other in the radius direction of the color disc and extending in the form of a ring, the subdivided sections of each group being colored in a recurrent sequence of three colors in the circumferential direction of the color disc.

4. A lighting apparatus according to claim 3, wherein the subdivided sections contained in one sector have a gradually decreasing radial width as they are located more outward in the radius direction of the color disc.

5. A lighting apparatus according to claim 3, wherein the subdivided sections of the same color within each of the groups forming a ring are shifted by one sector in the circumferential direction of the color disc with respect to the subdivided sections of the identical color within a group neighboring the first-mentioned group in the radius direction of the color disc.

6. A lighting apparatus according to claim 3, wherein said subdivided sections are individually colored in one of red, blue, and green.

7. A lighting apparatus according to claim 1, wherein said driving means further includes a pulley wheel arranged substantially at an outer peripheral edge of the light-intercepting disc, a driving pulley arranged in side-by-side relation to the light-intercepting disc substantially on a level with the pulley wheel, a driving belt wound around the driving pulley and the pulley wheel, and an electric motor for rotating the driving pulley.

8. A lighting apparatus according to claim 1, wherein said plurality of arms comprise three arms arranged substantially equidistantly in a circumferential direction of the frame and defining a large opening therebetween.

9. A lighting apparatus according to claim 8, wherein said frame serves as a member for mounting the color disc.

10. A lighting apparatus according to claim 1, further comprising a diffusing disc having a light transmitting capability and a light diffusing capability and arranged over the opening of the housing.

11. A lighting apparatus according to claim 1, wherein said opening of the housing comprises a substantially circular opening having a diameter slightly smaller than that of the light-intercepting disc, and said illuminating bulb has a substantially spherical shape.

12. A lighting apparatus according to claim 1, wherein each of said plurality of coloration patters has a spiral form.

13. A lighting apparatus according to claim 1, wherein said driving means rotates one of said color disc and light-intercepting disc at a speed such that the windows of said light-intercepting disc perfectly coincide with respective ones of the subdivided sections of said color disc only momentarily, so that a primary color is radiated only momentarily.

* * * * *